US008608340B2

(12) United States Patent
Oyaizu et al.

(10) Patent No.: US 8,608,340 B2
(45) Date of Patent: Dec. 17, 2013

(54) LIGHT-EMITTING MODULE AND LIGHTING APPARATUS WITH THE SAME

(75) Inventors: Tsuyoshi Oyaizu, Yokosuka (JP); Haruki Takei, Yokosuka (JP); Akiko Saito, Yokosuka (JP); Seiko Kawashima, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 263 days.

(21) Appl. No.: 13/169,814

(22) Filed: Jun. 27, 2011

(65) Prior Publication Data

US 2011/0317416 A1 Dec. 29, 2011

(30) Foreign Application Priority Data

Jun. 28, 2010 (JP) ..... 2010-146730
Jun. 28, 2010 (JP) ..... 2010-146733
Jun. 30, 2010 (JP) ..... 2010-150418

(51) Int. Cl.
*F21S 4/00* (2006.01)
*F21V 7/00* (2006.01)

(52) U.S. Cl.
USPC ..... 362/249.02; 362/235; 362/311.02; 362/249.06

(58) Field of Classification Search
USPC ..... 362/249.02, 249.06, 235, 84, 311.02, 362/294, 373, 230, 231, 545, 800; 315/294
See application file for complete search history.

(56) References Cited

U.S. PATENT DOCUMENTS 8,277,067 B2 * 10/2012 Park et al. ..... 362/249.02
8,324,837 B2 * 12/2012 Lin ..... 315/294
2005/0225222 A1 10/2005 Mazzochette
2009/0127721 A1 * 5/2009 Isono ..... 257/786
2009/0303715 A1 12/2009 Takasago
2010/0118548 A1 5/2010 Nezu
2011/0310590 A1 * 12/2011 Yamashita et al. ..... 362/249.02

FOREIGN PATENT DOCUMENTS

| | | |
|---|---|---|
| CN | 201348169 | 11/2009 |
| CN | 201407528 | 2/2010 |
| JP | 2008-300694 | 12/2008 |
| JP | 2008-311339 | 12/2008 |
| JP | 2009-044055 | 2/2009 |
| JP | 2009-088190 | 4/2009 |

(Continued)

OTHER PUBLICATIONS

U.S. Appl. No. 12/473,482 electronically captured on Oct. 19, 2012.

(Continued)

*Primary Examiner* — Bao Q Truong
(74) *Attorney, Agent, or Firm* — DLA Piper LLP (US)

(57) ABSTRACT

According to one embodiment, a light-emitting module includes a module substrate, a first wiring pattern provided on the module substrate and including a common wire connecting portion, a second wiring pattern provided on the module substrate and including a first wire connecting portion, a second wire connecting portion, and a middle pattern portion, a first light-emitting element group arranged between the common wire connecting portion and the first wire connecting portion and including semiconductor light-emitting elements connected in series and being electrically connected to the common wire connecting portion and the first wire connecting portion, and a second light-emitting element group arranged between the common wire connecting portion and the second wire connecting portion and including semiconductor light-emitting elements connected in series and being electrically connected to the common wire connecting portion and the second wire connecting portion.

14 Claims, 9 Drawing Sheets

(56) References Cited

FOREIGN PATENT DOCUMENTS

| | | |
|---|---|---|
| JP | 2009-094207 | 4/2009 |
| JP | 2009-135485 | 6/2009 |
| JP | 2009-164567 | 7/2009 |

OTHER PUBLICATIONS

U.S. Appl. No. 13/045,831 electronically captured on Oct. 19, 2012.
U.S. Appl. No. 13/045,831 electronically captured on Jul. 24, 2013.
U.S. Appl. No. 13/045,812 electronically captured on Jul. 24, 2013.
U.S. Appl. No. 12/615,753 electronically captured on Apr. 9, 2013.
U.S. Appl. No. 13/045,831 electronically captured on Apr. 9, 2013.
U.S. Appl. No. 13/045,812 electronically captured on Apr. 9, 2013.
Chinese Office Action issued in CN 201110176633.4 on Feb. 4, 2013.
English Language Translation of Chinese Office Action issued in CN 201110176633.4 on Feb. 4, 2013.
English Language Abstract of CN 201407528 published Feb. 17, 2010.
English Language Abstract of CN 201348169 published Nov. 18, 2009.
English Language Abstract of JP 2009-088190 published Apr. 23, 2009.
English Language Translation of JP 2009-088190 published Apr. 23, 2009.
English Language Abstract of JP 2009-044055 published Feb. 26, 2009.
English Language Translation of JP 2009-044055 published Feb. 26, 2009.
English Language Abstract of JP 2009-094207 published Apr. 30, 2009.
English Language Translation of JP 2009-094207 published Apr. 30, 2009.
Partial Image File Wrapper of U.S. Appl. No. 13/045,831 electronically captured on Oct. 2, 2013 between Jul. 24, 2013 to Oct. 2, 2013.
Japanese Office Action issued in JP 2010-030806 on Jul. 2, 2013.
English Language Translation of Japanese Office Action issued in JP 2010-030806 on Jul. 2, 2013.
English Language Abstract of JP 2009-164567 published 23, 2009.
English Language Translation of JP 2009-164567 published 23, 2009.
English Language Translation for JP 2009-135485 published on Jun. 18, 2009.
English Language Abstract for JP 2008-300694 published on Dec. 11, 2008.
English Language Translation for JP 2008-300694 published on Dec. 11, 2008.
English Language Abstract for JP 2008-311339 published on Dec. 25, 2008.
English Language Translation for JP 2008-311339 published on Dec. 25, 2008.
Japanese Office Action issued in JP 2010-146733 dated Oct. 9, 2013.
English Language Translation for Japanese Office Action issued in JP 2010-146733 dated Oct. 9, 2013.
Image File Wrapper of Related U.S. Appl. No. 13/045,812 electronically captured on Oct. 30, 2013.

* cited by examiner

LIGHT-EMITTING MODULE AND LIGHTING APPARATUS WITH THE SAME

CROSS-REFERENCE TO RELATED APPLICATIONS

This application is based upon and claims the benefit of priority from Japanese Patent Applications No. 2010-146730, filed Jun. 28, 2010; No. 2010-146733, filed Jun. 28, 2010; and No. 2010-150418, filed Jun. 30, 2010; the entire contents of all of which are incorporated herein by reference.

FIELD

Embodiments described herein relate generally to a light-emitting module suitably usable for, for example, a light source, and a lighting apparatus such as a streetlamp comprising the light-emitting module as a light source.

BACKGROUND

A chip-on-board (COB) type light-emitting module having the following configuration is proposed. Positive and negative wiring patterns are alternately provided on a module substrate. Semiconductor light-emitting elements connected in series such as chip-shaped light-emitting diodes (LEDs) are arranged between a pair of positive and negative wiring patterns. These LEDs are electrically connected to the wiring patterns by bonding wires. The wiring patterns, the LEDs, and others are buried by a translucent sealing resin.

In order to obtain white light from the light-emitting module, LEDs for generating blue light are generally used, and a sealing resin mixed with a yellow fluorescent material that is excited by blue light and emits yellow light is used as the sealing resin. Thus, the surface of the sealing resin functions as a white light-emitting surface.

The COB type light-emitting module comprising the above-mentioned configuration has the following problem.

That is, in this light-emitting module, a light-emitting system comprises LED rows arranged between the pair of positive and negative wiring patterns, and such light-emitting systems are provided side by side in the extending direction of the LED rows so that the LED rows are in matrix form. Therefore, the LED rows can be arranged in a substantially square region.

However, the above-mentioned configuration requires a space to keep an insulation distance between adjacent light-emitting systems. Moreover, as each of the light-emitting systems comprises the pair of positive and negative wiring patterns, the above-mentioned configuration also requires a space to arrange the individual wiring patterns. This leads to a greater space to arrange all the LEDs. Moreover, as the positive and negative wiring patterns are provided for each of the light-emitting systems, the number of wiring patterns is great, which is one of the causes of the high manufacturing costs.

Such a problem can be solved by providing a single light-emitting system, that is, by increasing the number of LEDs included in each LED row and providing one light-emitting system that comprises a single positive wiring pattern and a single negative wiring pattern across the LED rows. However, in such a configuration, a voltage applied to each LED row increases in response to the increase in the number of LEDs included in each LED row. The circuit configuration of a power supply unit for supplying such a high voltage has to be capable of resisting and supplying the high voltage. Therefore, the increase of costs is inevitable.

DETAILED DESCRIPTION

Figure 1:
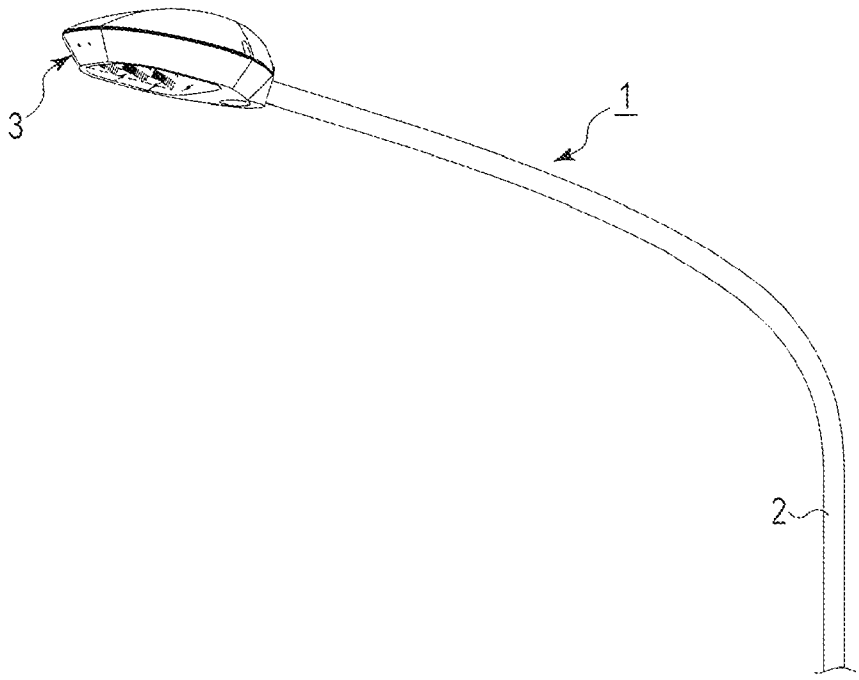
FIG. 1 is a perspective view showing a streetlamp comprising a light-emitting module according to an embodiment.

In general, according to one embodiment, a light-emitting module comprises: a module: substrate; a first wiring pattern provided on the module substrate and having a common wire connecting portion; a second wiring pattern provided on the module substrate around the first wiring pattern and opposite in polarity from the first wiring pattern, the second wiring pattern having a first wire connecting portion which defines a first element arrangement area between the first wire connecting portion and the common wire connecting portion, a second wire connecting portion which is opposite to the first wire connecting portion across the common wire connecting portion and which defines a second element arrangement area between the second wire connecting portion and the common wire connecting portion, and a middle pattern portion connecting the first wire connecting portion to the second wire connecting portion; a first light-emitting element group arranged in the first element arrangement area and including semiconductor light-emitting elements connected in series and electrically connected to the common wire connecting portion and the first wire connecting portion; and a second light-emitting element group arranged in the second element arrangement area and including semiconductor light-emitting elements connected in series and electrically connected to the common wire connecting portion and the second wire connecting portion.

According to Embodiment 1, the module substrate may be made of any one of a synthetic resin such as an epoxy resin, a metal base substrate in which insulating layers are stacked on a metal plate, and an inorganic material such as ceramics. When the module substrate is made of white ceramics, one or a composite of the substances selected from the group consisting of aluminum oxide (alumina), aluminum nitride, boron nitride, silicone nitride, magnesium oxide, forsterite, steatite, and low-temperature sintered ceramics can be used as the ceramics. In particular, inexpensive and easily processible alumina having high light reflectance can be suitably used.

In this Embodiment 1, the first and second wiring patterns can be made of a metal such as copper, silver, or gold. However, the first and second wiring patterns are preferably made of silver in that silver costs less than gold and in that when the light-emitting module is configured to emit, for example, white light, the color of the wiring patterns tends to less affect the emitted light. In this embodiment, one of the first wiring pattern and the second wiring pattern is positive, and the other is negative. The wire connecting portions, of these wiring patterns mean parts to which bonding wires are connected. In this Embodiment 1, the wiring pattern made of metal containing silver as the main component includes, for example, a wiring pattern made of pure silver and a wiring pattern made of silver plating.

In this Embodiment 1, various light-emitting elements in which a compound semiconductor is provided on, for example, an element substrate can be used for the semiconductor light-emitting elements, and blue bare-chip LEDs that emit blue light are particularly preferably used. However, semiconductor light-emitting elements that emit ultraviolet rays or green light can also be used. Alternatively, semiconductor light-emitting elements other than LEDs may also be used.

In Embodiment 1, metal thin wires such as a gold wire, an aluminum wire, a copper wire, and a platinum wire can be used for the bonding wires. However, the gold wire that is high in moisture resistance, environmental resistance, adherence, electric conductivity, and extensibility is particularly preferably used as the bonding wire.

In the light-emitting module according to Embodiment 1, the common wire connecting portion of the first wiring pattern is shared by the first and second light-emitting element groups that are respectively arranged in the first and second element arrangement areas so that the first wiring pattern is surrounded by the second wiring pattern. As a result, there is no need for a space to keep an inter-wiring-pattern insulation distance between a first light-emitting system constituted of the first light-emitting element group and an adjacent second light-emitting system constituted of the second light-emitting element group. Moreover, the common wire connecting portion can reduce the number of wiring patterns necessary for the whole light-emitting module, more specifically, the number of wire connecting portions.

In addition, the first light-emitting element group includes a plurality of first light-emitting element rows and the second light-emitting element group includes a plurality of the second light-emitting element rows. The first light-emitting element rows and the second light-emitting element rows that are arranged on both sides of the common wire connecting portion are electrically parallel to each other. Thus, since the number of semiconductor light-emitting elements provided in each light-emitting element row does not increase, each light-emitting element row can emit light by the application of a low voltage.

In the light-emitting module according to Embodiment 2, in Embodiment 1, the first light-emitting element rows and the second light-emitting element rows are arranged on both sides of the common wire connecting portion so that a total element row length which is the sum of the lengths of the first and second light-emitting element rows is substantially equal to the length of the common wire connecting portion.

In this Embodiment 2, there is no or a small dimensional difference between the longitudinal and lateral sides of a region where all the semiconductor light-emitting elements are mounted, as compared with a configuration in which all the light-emitting element rows are arranged in the extending direction of the common wire connecting portion. Therefore, the above-mentioned region is not in an elongate form. Thus, according to this Embodiment 2, in the first embodiment, the distribution of the light exiting from the light-emitting module can be uniform in each direction.

In the light-emitting module according to Embodiment 3, in Embodiment 1 or 2, a pattern base of the first wiring pattern with which the common wire connecting portion is continuous is provided at an inter-base insulation distance side by side with a pattern base of the second wiring pattern with which one of the first and second wire connecting portions is continuous. A double-pin power supply connector, serving as a power supply portion, including two terminal pins is mounted on the module substrate, and the two terminal pins are individually connected to both of the pattern bases.

According to Embodiment 3, in Embodiment 1 or 2, the first wiring pattern and the second wiring pattern have only to be further provided as the wiring patterns necessary to supply power to each light-emitting element row. Therefore, the general-purpose low-cost double-pin connector can be used for the power supply connector. In addition, a great inter-base insulation distance can be kept between the pattern bases of the first and second wiring patterns. Thus, when the first and second wiring patterns are made of silver, a short circuit between the pattern bases of the first and second wiring patterns caused by, if any, silver migration can be prevented for a long period.

In the light-emitting module according to Embodiment 4, in any one of Embodiments 1 to 3, the end of the common wire connecting portion and a longitudinal middle portion of the middle pattern portion are separate from each other at an insulation distance equal to or more than the inter-base insulation distance.

According to this Embodiment 4, in any one of Embodiments 1 to 3, when both the wiring patterns are made of silver, a short circuit between the common wire connecting portion and the middle pattern portion caused by, if any, silver migration can be prevented for a long period.

In the light-emitting module according to Embodiment 5, in any one of Embodiments 1 to 4, the first light-emitting element rows and the second light-emitting element rows are symmetrical with respect to the common wire connecting portion. Alignment marks made of the same metal as both the wiring patterns are provided on the module substrate to extend from the respective light-emitting element rows. Among the alignment marks, the alignment mark located close to the first wire connecting portion is 1.0 mm or more apart from the edge of the first wire connecting portion, and the alignment mark located close to the second wire connecting portion is 1.0 mm or more apart from the edge of the second wire connecting portion.

According to this Embodiment 5, in any one of Embodiments 1 to 4, both the wiring patterns and the alignment marks are made of the same metal, and can therefore be formed on the module substrate in the same process.

In the meantime, when the semiconductor light-emitting elements are mounted in the element arrangement areas of the module substrate by a mounting machine, this mounting machine recognizes a pair of alignment marks provided across the first and second element arrangement areas, and mounts the semiconductor light-emitting elements at intervals on a straight line (mounting line) that runs through the alignment marks. In this mounting, when the mounting machine correctly recognizes the pair of alignment marks, correct mounting is achieved. However, the distance between alignments that form alignment mark rows is small, the mounting machine may incorrectly recognize the alignment marks and improperly mount the semiconductor light-emitting elements. In this case, some of the semiconductor light-emitting elements to be mounted on a faulty mounting line based on the incorrect recognition may interfere with some of the semiconductor light-emitting elements that have already been normally mounted.

However, in Embodiment 5, the alignment marks provided in line to extend along the first and second wire connecting portions are 1.0 mm or more apart from the edges of the first and second wire connect portions. Thus, in this Embodiment 5, the faulty mounting line based on the incorrect recognition is less tilted relative to the normal mounting line on which the semiconductor light-emitting elements have already been mounted, so that the inter-line distance on the side where these lines converge can be longer. As a result, it is possible to inhibit the semiconductor light-emitting elements to be mounted on the faulty mounting line from interfering with the semiconductor light-emitting elements that have already been mounted in the normal mounting line.

In the light-emitting module according to Embodiment 6, in Embodiment 5, the distance between the alignment mark and the edge of the module substrate is longer than the insulation distance between the alignment mark and the first and second wire connecting portions.

According to this Embodiment 6, in Embodiment 5, a creepage distance necessary for insulation can be kept between each alignment and the module substrate. In addition, in handling such as carriage and setting during the manufacture of the light-emitting module, a part that allows the module substrate to be handled without interfering with the alignment marks can be secured in the peripheral part of the module substrate.

A lighting apparatus according to Embodiment 7 comprises a light source device which comprises, as a light source, the light-emitting module according to any one of Embodiments 1 to 6; and an apparatus body to which the light source device is attached. Embodiment 7 is not limited to a streetlamp described in later-described Example 1 and is applicable to any type of lighting apparatus.

In the lighting apparatus according to Embodiment 7, the light source device is provided with, as a light source, the light-emitting module according to any one of Embodiments 1 to 6. Thus, an area to provide semiconductor light-emitting element group in this module is small, and the amount of a metal that constitutes wiring patterns can be reduced. Moreover, light can be emitted by the application of a low voltage.

There will now be described a lighting apparatus such as a streetlamp comprising a light-emitting module according to an embodiment will be described below in detail with reference to FIG. 1 to FIG. 10. In FIG. 10, a later-described protective layer is not shown to simplify the explanation.

FIG. 1 shows a streetlamp 1 installed for road illumination. The streetlamp 1 comprises a pillar 2, and a lamp instrument 3 attached to the upper end of the pillar 2. The pillar 2 stands by the roadside, and the upper part of the pillar 2 is bent to hang over the road.

Figure 2:
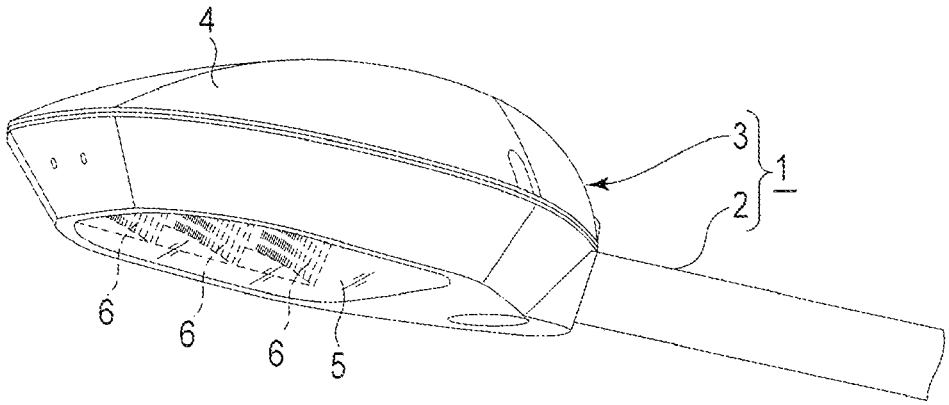
FIG. 2 is a perspective view showing a lamp instrument of the streetlamp.

As shown in FIG. 2, the lamp instrument 3 comprises a lamp body 4 such as an apparatus body coupled to the pillar 2, a translucent plate 5 attached to the lamp body 4 to block the lower opening of the lamp body 4 that faces the road, and at least one light source device 6 housed in the lamp body 4 to face the translucent plate 5. The lamp body 4 is produced by a combination of die-cast molded articles made of a metal such as aluminum. The translucent plate 5 is made of reinforced glass.

Figure 3:
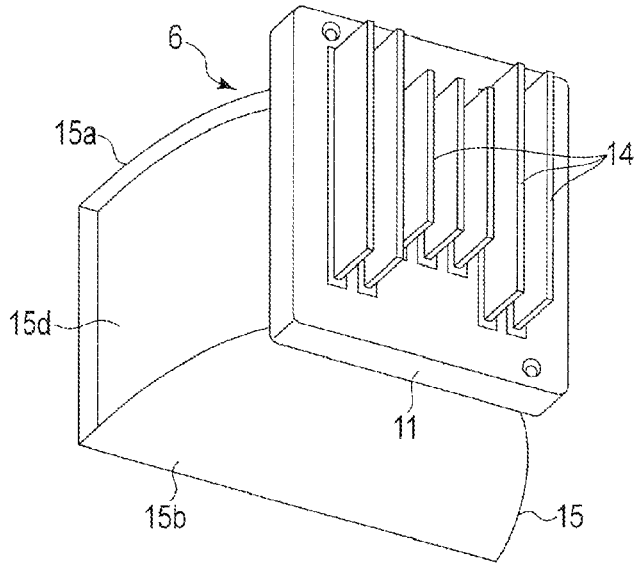
FIG. 3 is a perspective view showing a light source device provided in the lamp instrument.
Figure 4:
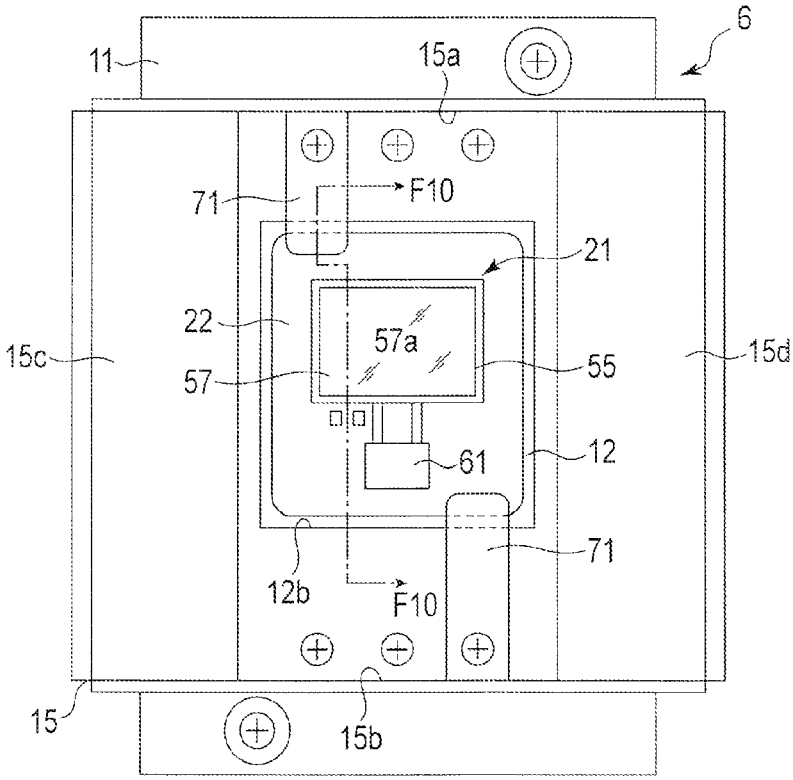
FIG. 4 is a front view schematically showing the light source device.

As shown in FIG. 3 and FIG. 4, the light source device 6 comprises a substantially rectangular device base 11, heat release fins 14 protruding on the rear surface of the device base, a reflector 15 provide in the front surface of the device base 11, and a light-emitting module 21 as a light source. These components are combined into a unit.

The device base 11 is a die-cast product made of a metal such as aluminum, and is quadrangular. The device base 11 has, in its front surface, a module placement portion 12 (see FIG. 4 and FIG. 10) which is an open quadrangular recess. A bottom surface 12*a* of the module placement portion 12 is flat, and four side surfaces 12*b* that marks off the module placement portion 12 are continuous with one another at right-angles. The heat release fins 14 are formed integrally with the device base 11.

The reflector 15 is produced by combining first, second, third, and fourth reflecting plates 15*a*, 15*b*, 15*c*, and 15*d* into a horn shape. The first reflecting plate 15*a* and the second reflecting plate 15*b* are flat plane mirrors, and are provided parallel to each other. The third reflecting plate 15*c* and the fourth reflecting plate 15*d* that are coupled to the first reflecting plate 15*a* and the second reflecting plate 15*b* are curved mirrors, and are provided so that the distance therebetween gradually widens.

The light source device 6 is fixed in the lamp body 4 so that the entrance opening of the reflector 15 faces the translucent plate 5. In the fixed condition, a part, for example, a peripheral portion of the device base 11 is thermally conductively connected to the inner surface of the lamp body 4. This thermal connection can be obtained not only by the direct contact of the peripheral portion to the inner surface of the lamp body 4 but also by connecting the peripheral portion to the inner surface of the lamp body 4 via a thermally conductive member such as a metal having good heat release properties or a heat pipe. As a result, heat generated by the light source device 6 can be released to the outside using the metal lamp body 4 as a heat release surface.

Now, The light-emitting module 21 is described. As shown in FIG. 4, FIG. 5, FIG. 6, FIG. 7, and others, the light-emitting module 21 comprises a module substrate 22, a first wiring pattern such as a positive wiring pattern 25, a second wiring pattern such as a negative wiring pattern 26, alignment marks 35 and 36, a first protective layer 37, a second protective layer 38, identity marks such as first, second, third, and fourth identity marks 41, 42, 43, and 44, semiconductor light-emitting elements 45, bonding wires 47 to 52, a frame 55, a sealing resin 57, a power supply connector 61 serving as a power supply portion, a condenser 65, etc.

The module substrate 22 is made of white ceramics, for example, white $AL_2O_3$ (aluminum oxide). The module substrate 22 may be made of aluminum oxide alone, but may be made of a material which includes aluminum oxide as the main component and also includes other materials such as ceramics mixed therein. In this case, as aluminum, oxide is included as the main component, the content of aluminum oxide is preferably 70% or more.

The average reflectance of the white module substrate 22 relative to a visible light region is 80% or more, and is particularly preferably 85% or more and 99% or less. The module substrate 22 shows similar light-reflecting performance for blue light having a specific emission wavelength of 440 nm to 460 nm emitted by a later-described blue LED and yellow light having a specific emission wavelength of 470 nm to 490 nm emitted by a later-described fluorescent material.

Figure 5:
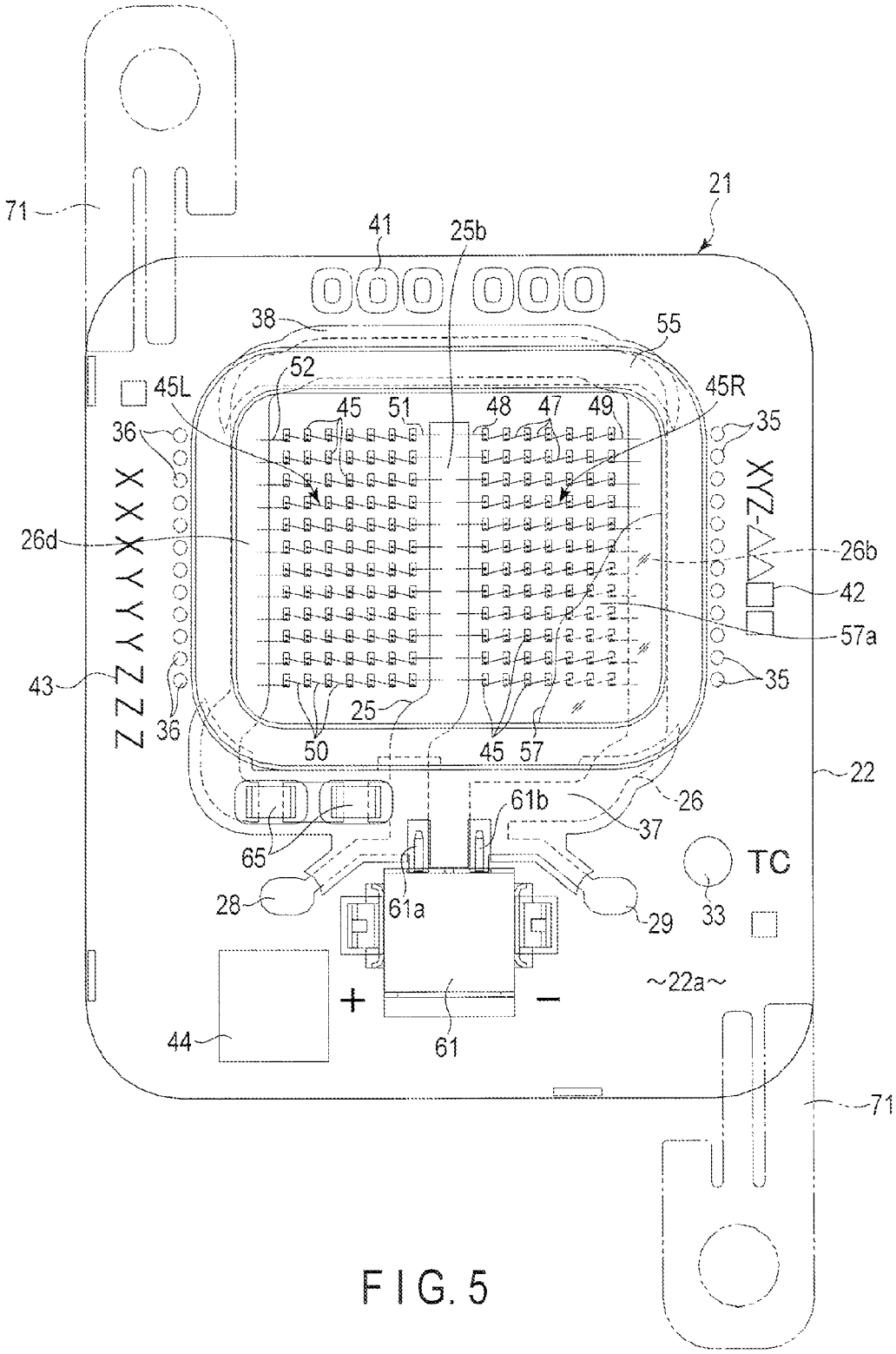
FIG. 5 is a front view showing the light-emitting module provided in the light source device.

As shown in FIG. 4, the module substrate 22 is in a quadrangular shape slightly smaller than the module placement portion 12. As shown in FIG. 5, four corners of the module substrate 22 are rounded. As shown in FIG. 10, the thickness of the module substrate 22 is smaller than the depth of the module placement portion 12. Both surfaces of the module substrate 22 are flat surfaces parallel to each other, and one of these surfaces is used as a component mounting surface 22*a*.

Figure 6:
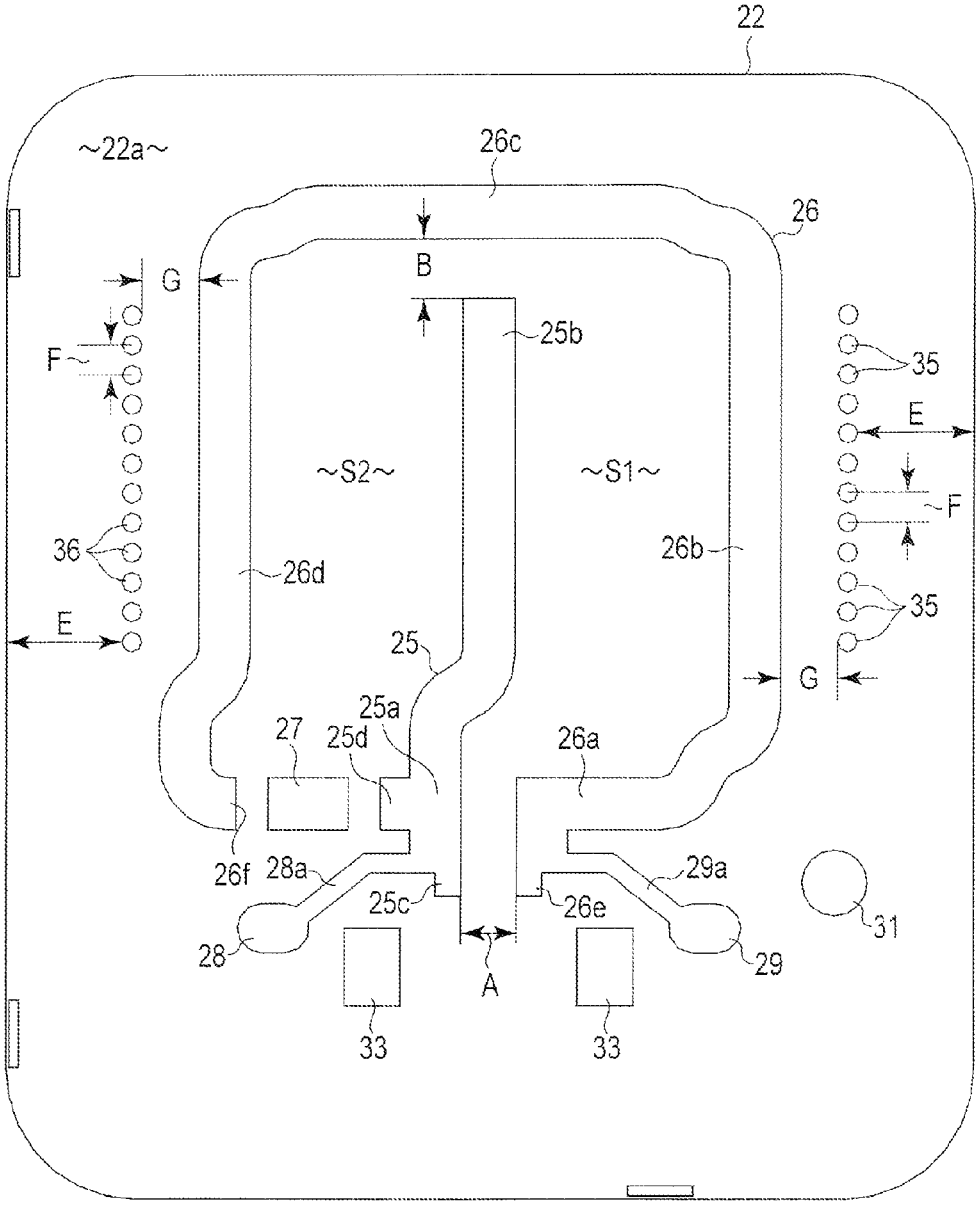
FIG. 6 is a front view showing the light-emitting module after a first manufacturing process.

The positive wiring pattern 25 and the negative wiring pattern 26 are provided in the component mounting surface 22*a*. In more detail, as shown in FIG. 6 and others, the positive wiring pattern 25 comprises a positive pattern base 25*a* and a common wire connecting portion 25*b*. The common wire connecting portion 25*b* extends straight. The common wire connecting portion 25*b* linearly extends on, for example, the central axis of the component mounting surface 22*a*. The positive pattern base 25*a* and the common wire connecting portion 25*b* are substantially parallel to each other, and are continuous with each other via a slanted pattern portion. A first positive pad portion 25*c* and a second positive pad portion 25*d* integrally protrude from the positive pattern base 25*a*.

The negative wiring pattern 26 comprises a negative pattern base 26*a*, a first wire connecting portion 26*b*, a middle pattern portion 26*c*, and a second wire connecting portion 26*d*. The negative wiring pattern 26 is provided around the positive wiring pattern 25.

That is, the negative pattern base 26*a* is provided adjacent to the positive pattern base 25*a* at a predetermined inter-base insulation distance A (see FIG. 6). A first negative pad portion 26*e* integrally protrudes from the negative pattern base 26*a*, and is provided side by side with the first positive pad portion 25*c*. The first wire connecting portion 26*b* is continuous with the negative pattern base 26*a* at an angle of about 90°. The first wire connecting portion 26*b* is provided substantially parallel to the common wire connecting portion 25*b* of the positive wiring pattern 25 so that a first element arrangement area S1 is formed between the first wire connecting portion 26*b* and the common wire connecting portion 25*b*. The "substantially parallel" referred to here includes, for example, a parallel condition shown in FIG. 6, or a condition in which the first wire connecting portion 26*b* is slightly inclined relative to the common wire connecting portion 25*b*, or a condition in which the first wire connecting portion 26*b* is slightly curved.

The middle pattern portion 26*c* is provided to be continuous with the first wire connecting portion 26*b* at an angle of about 90°. A longitudinal middle portion of the middle pattern portion 26*c* is adjacent to the end (the end opposite to the positive pattern base 25*a*) of the common wire connecting portion 25*b* at an insulation distance B (see FIG. 6) equal to or more than the inter-base insulation distance A. In order to keep the insulation distance B, both ends of the middle pattern portion 26*c* are inclined in opposite direction, so that the middle pattern portion 26*c* is substantially curved. Thus, the longitudinal middle portion of the middle pattern portion 26*c* is kept away from the end of the common wire connecting portion 25*b*.

The second wire connecting portion 26*d* is integrally provided to be continuous with the middle pattern portion 26*c* at an angle of about 90°. Thus, the second wire connecting portion 26*d* is provided substantially parallel to the common wire connecting portion 25*b* of the positive wiring pattern 25, and a second element arrangement area S2 is formed between the second wire connecting portion 26*d* and the common wire connecting portion 25*b*. The "substantially parallel" referred to here includes, for example, a parallel condition shown in FIG. 6, or a condition in which the second wire connecting portion 26*d* is slightly inclined relative to the common wire connecting portion 25*b*, or a condition in which the second wire connecting portion 26*d* is slightly curved.

Therefore, the negative wiring pattern 26 is provided to surround the positive wiring pattern 25 from three sides. The first wire connecting portion 26*b* and the second wire connecting portion 26*d* of the negative wiring pattern 26 are provided symmetrically with respect to the common wire connecting portion 25*b* of the positive wiring pattern 25 which is provided in the center of the region surrounded by the negative wiring pattern 26.

A second negative pad portion 26*f* is integrally provided to be continuous with the end of the second wire connecting portion 26*d*, and faces the second positive pad portion 25*d* at a distance. The second negative pad portion 26*f* is separate from the second positive pad portion 25*d*. A middle pad 27 is formed in the component mounting surface 22*a* between the second negative pad portion 26*f* and the second positive pad portion 25*d*.

The wiring pattern 25 may be negative and the wiring pattern 26 may be positive. In this case, the "positive" in the above explanation can be read as "negative", the "negative" can be read as "positive". Moreover, the second wire connecting portion 26*d* can be directly continuous with the negative pattern base 26*a*. In this case, the middle pattern portion 26*c* can be provided between the first wire connecting portion 26*b* and the positive pattern base 25*a*.

Figure 7:
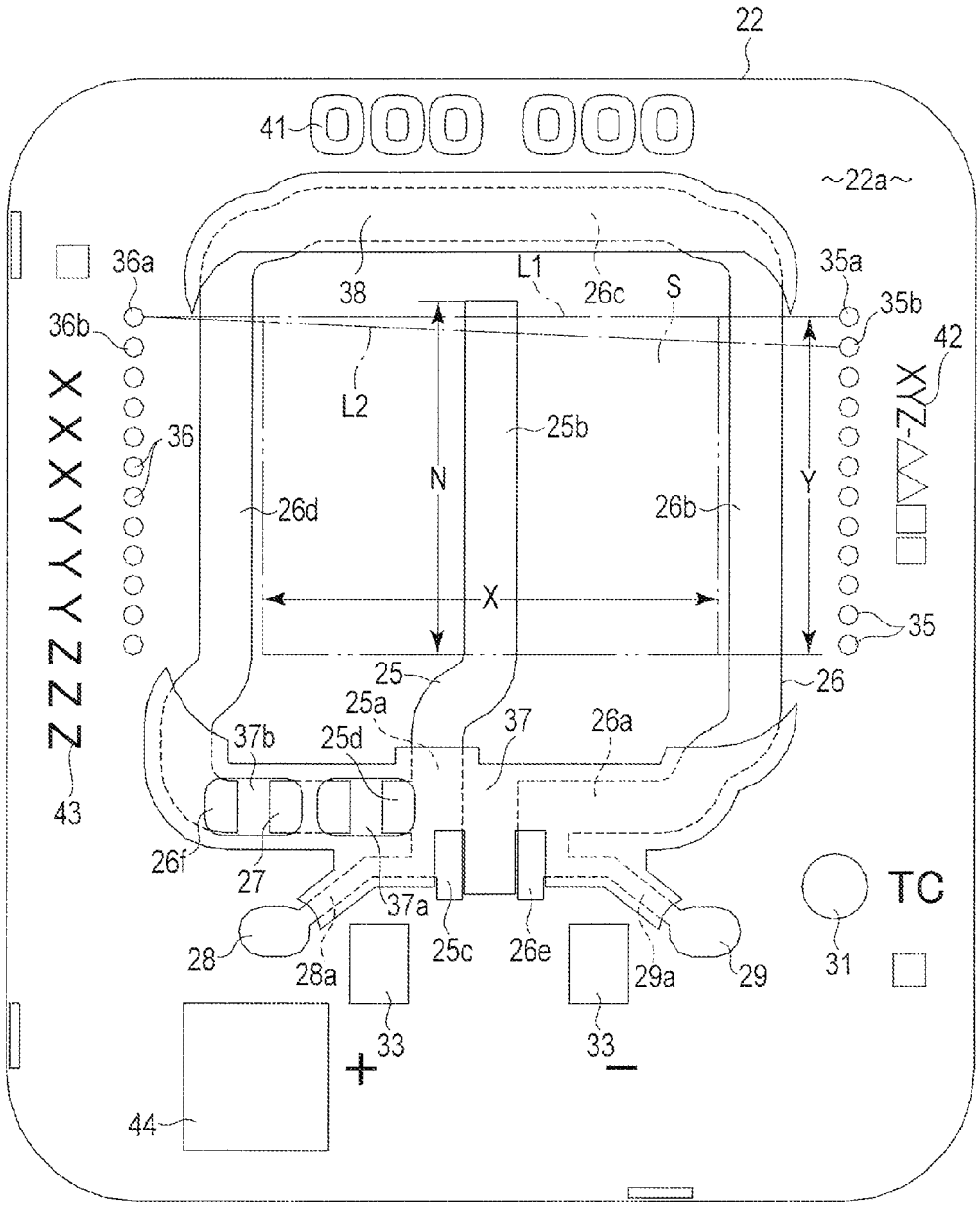
FIG. 7 is a front view showing the light-emitting module after a second manufacturing process.

Furthermore, as shown in FIG. 5 to FIG. 7, the component mounting surface 22*a* is provided with lighting inspection pads 28 and 29 for a lighting check test, a temperature inspection pad 31 for temperature measurement, and mounting pads 33 for fixing components.

That is, the lighting inspection pad 28 is connected to the positive wiring pattern 25. More specifically, the lighting inspection pad 28 is provided via a pattern portion 28*a* which branches and integrally protrudes from the positive pattern base 25*a*. Similarly, the lighting inspection pad 29 is connected to the negative wiring pattern 26. More specifically, the lighting inspection pad 29 is provided via a pattern portion 29*a* which branches and integrally protrudes from the negative pattern base 26*a*.

The temperature inspection pad 31 is independently provided in the vicinity of the lighting inspection pad 29 and the negative wiring pattern 26 without any electrical connection therebetween. A thermocouple can be connected to the temperature inspection pad 31 to measure the temperature of the light-emitting module 21.

A pair of mounting pads 33 are formed, and provided between the lighting inspection pads 28 and 29.

The alignment marks 25 and 36 are provided on both sides across the common wire connecting portion 25*b*, the first element arrangement area S1 and the second element arrangement area S2 located on both sides of the common wire connecting portion 25*b*, the first wire connecting portion 26*b* adjacent to the first element arrangement area S1, and the second wire connecting portion 26*d* adjacent to the second element arrangement area S2.

More specifically, the alignment marks (first alignment marks) 35 are provided in line along the longitudinal direction of the first wire connecting portion 26*b*, that is, along one side of the mounting surface 22*a*. The alignment marks 35 are apart from the edge of the first wire connecting portion 26*b*, and a distance G (see FIG. 6) therebetween is preferably 1.0 mm or more, for example, 1.2 mm to 2.0 mm, more specifically, 1.6 mm. Each of the alignment marks 35 is provided at a distance E (see FIG. 6) from the edge of the module substrate 22, and the distance E is longer than the distance G. An arrangement pitch F (see FIG. 6) between adjacent alignment marks 35 is equal to the arrangement pitch of later-described light-emitting element rows along the longitudinal direction of the common wire connecting portion 25*b*.

Similarly, the alignment marks (second alignment marks) 36 are provided in line along the longitudinal direction of the second wire connecting portion 26*d*, that is, along the other side of the mounting surface 22*a*. The alignment marks 36 are apart from the edge of the second wire connecting portion 26*d*, and a distance G (see FIG. 6) therebetween is preferably 1.0 mm or more, for example, 1.2 mm to 2.0 mm, more specifically, 1.6 mm. Each of the alignment marks 36 is provided at a distance E (see FIG. 6) from the edge of the module substrate 22, and the distance E is longer than the distance G. An arrangement pitch F (see FIG. 6) between adjacent alignment marks 36 is equal to the arrangement pitch of the later-described light-emitting element rows.

The wiring patterns 25 and 26, the middle pad 27, the lighting inspection pads 28 and 29, the temperature detection pad 31, the mounting pads 33, and the alignment marks 35 and 36 are made of the same metal, for example, a metal containing silver as the main component, and are provided on the mounting surface 22*a* by printing such as screen printing (first manufacturing process). These components can also be formed by plating instead of printing.

The first protective layer 37 and the second protective layer 38 are made of an electric insulating material, and are printed on the mounting surface 22*a* by screen printing. The first protective layer 37 and the second protective layer 38 are provided to cover parts of the silver printings that are not enclosed by the later-described sealing resin 57 in order to prevent the deterioration of these parts (second manufacturing process). An electric insulating inorganic material such as glass or glass containing $SiO_2$ as the main component can be suitably used for the first and second protective layers. A pigment that colors the protective layers may be mixed or not mixed in the layers.

That is, as shown in FIG. 7, the first protective layer 37 is laid over the positive pattern base 25*a* except for the first positive pad portion 25*c* and the second positive pad portion 25*d*, and is also laid over the negative pattern base 26*a* except for the first negative pad portion 26*e*. Moreover, the first protective layer 37 is laid over a gap that keeps the inter-base insulation distance A between the positive pattern base 25*a* and the negative pattern base 26*a*, and is also laid over the pattern portions 28*a* and 29*a* except for the lighting inspection pads 28 and 29. In addition, the first protective layer 37 is laid over the end of the second wire connecting portion 26*d* on the side of the second negative pad portion 26*f* except for the second negative pad portion 26*f*, and is also laid over the middle pad 27 except for both ends of the middle pad 27.

For the above-mentioned laying, as shown in FIG. 7 and others, the first protective layer 37 has a first clearance 37*a* which extends over and exposes the second positive pad portion 25*d* and one end of the middle pad 27, and a second clearance 37*b* which extends over and exposes the second negative pad portion 26*f* and the other end of the middle pad 27. The first protective layer 37 is laid an outside of the sealing member 57 in such a manner as to be limited to the size of the periphery of the sealing member as described above.

As shown in FIG. 7, the second protective layer 38 is laid over substantially the whole middle pattern portion 26*c* of the negative wiring pattern 26, which is included in the part outside the sealing member which is not enclosed by the later-described sealing resin 57. The second protective layer 38 is also laid over the part outside the sealing member in such a manner as to be limited to the size of the periphery of this part.

Figure 8:
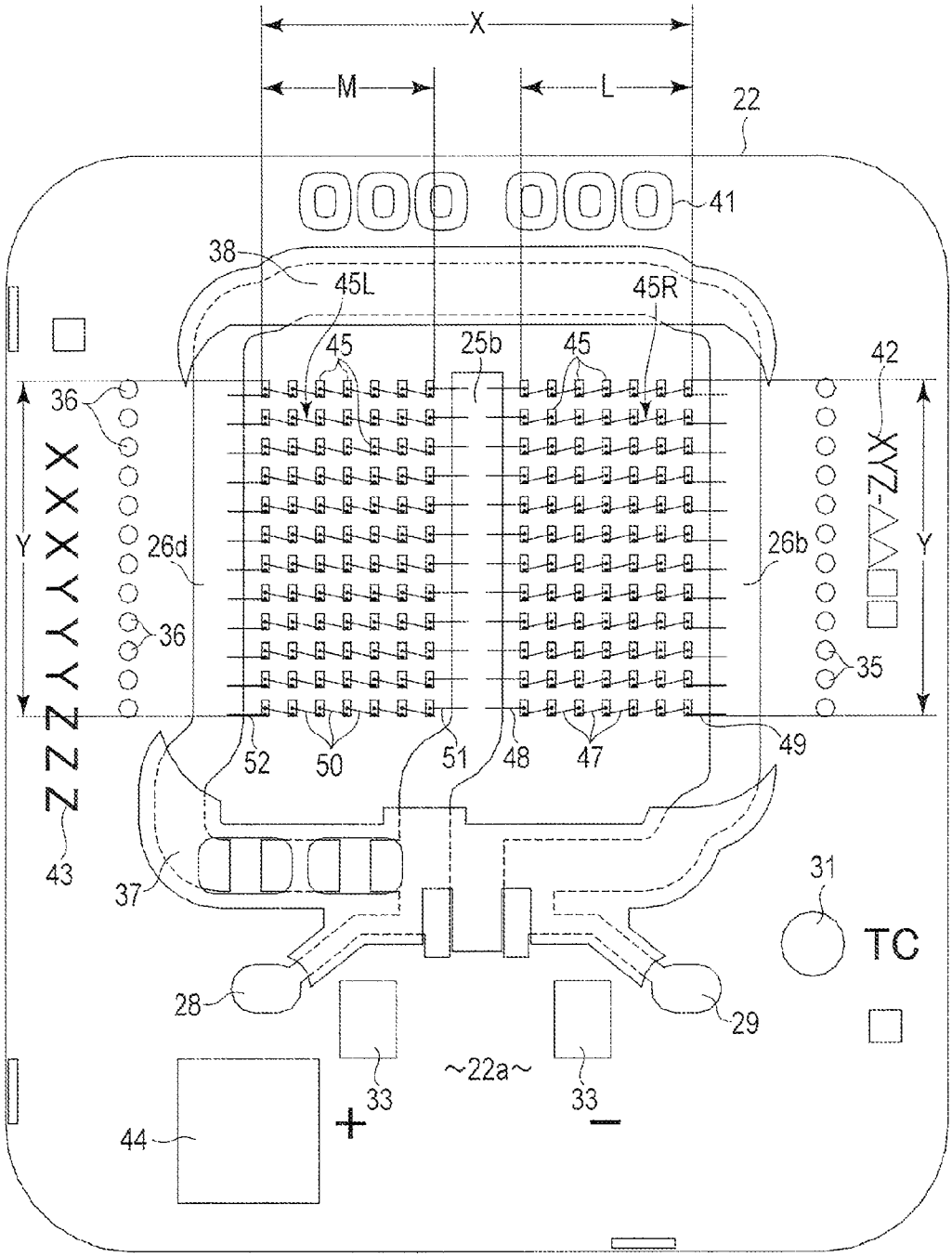
FIG. 8 is a front view showing the light-emitting module after a third manufacturing process.

The first identity mark 41 to the fourth identity mark 44 are provided on the mounting surface 22*a* by, for example, screen printing in colors different from the color of the module substrate 22 (third manufacturing process). Moreover, as shown in FIG. 7, FIG. 8, and others, polarity indications such as "+" and "−" are also provided on the mounting surface 22*a* by the printing. For example, the first identity mark 41 indicates a company name that shows a manufacturer, the second identity mark 42 indicates a product name, the third identity mark 43 indicates a product number, and the fourth identity mark 44 indicates a two-dimensional barcode (QR code) that shows information on the light-emitting module 21.

A light-emitting element that generates heat when emitting light, such as a chip-shaped LED that emits blue light is used for each of the semiconductor light-emitting elements 45. Each of the semiconductor light-emitting elements 45 preferably comprises a bare chip that includes a semiconductor light-emitting layer provided on a sapphire glass translucent element substrate and a pair of element electrodes provided on the light-emitting layer.

The LED emits light by the passage of a forward current through a p-n junction of a semiconductor. Therefore, the LED is a solid state component that directly converts electric energy to light. The semiconductor light-emitting element that emits light by such a light emission principle is more effective in energy saving than an incandescent light bulb that passes electricity through a filament and thereby incandesces the filament to a high temperature to emit visible light by its thermal radiation.

Figure 9:
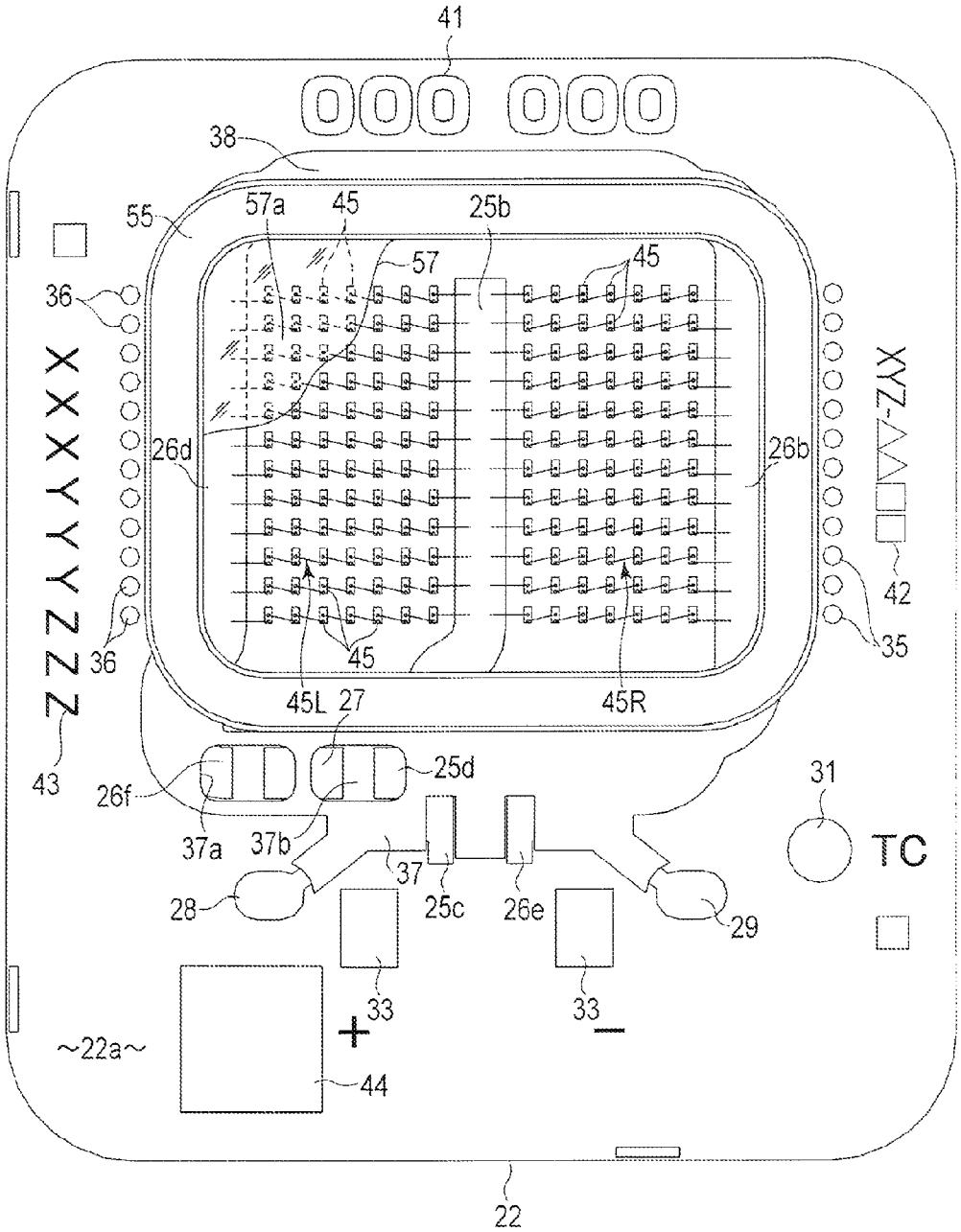
FIG. 9 is a front view showing the light-emitting module after a fourth manufacturing process.
Figure 10:
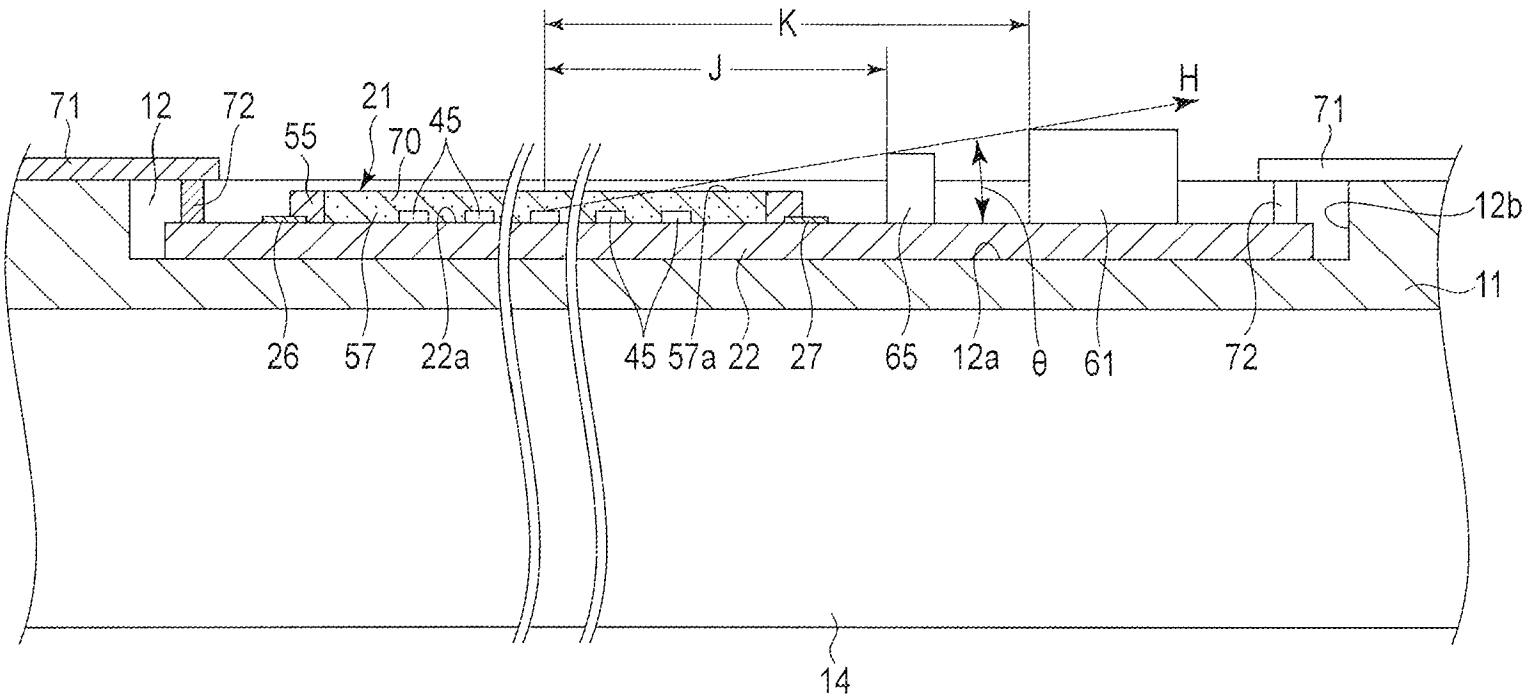
FIG. 10 is a sectional view taken along the line F10-F10 in FIG. 4.

As shown in FIG. 5, FIG. 8, and FIG. 9, half of the semiconductor light-emitting elements 45 are directly mounted on the module substrate 22 in the first element arrangement area S1. This mounting is achieved by using a transparent die bonding material to bond the element substrates to the mounting surface 22*a*. The semiconductor light-emitting elements 45 mounted in the first element arrangement area S1 are longitudinally and laterally aligned and arranged in matrix form. Similarly, the rest of the semiconductor light-emitting elements 45 are directly mounted on the module substrate 22 in the second element arrangement area S2. This mounting is also achieved by using the transparent die bonding material to bond the element substrates to the mounting surface 22*a*. The semiconductor light-emitting elements 45 mounted in the second element arrangement area S2 are also longitudinally and laterally aligned and arranged in matrix form.

The semiconductor light-emitting elements 45 of a first light-emitting element group arranged in the first element arrangement area S1 and the semiconductor light-emitting elements 45 of a second light-emitting element group arranged in the second element arrangement area S2 are provided symmetrically with respect to the common wire connecting portion 25*b*.

The semiconductor light-emitting elements 45 extending in line in a direction across the common wire connecting portion 25*b* and the first wire connecting portion 26*b*, e.g., in a direction perpendicular to the common wire connecting portion 25*b* and the first wire connecting portion 26*b* are connected in series to each other by the bonding wire 47. The semiconductor light-emitting element 45 which is thus connected in series and disposed at one end of a first light-emitting element row 45R (see FIG. 5, FIG. 8, and FIG. 9) is connected to the common wire connecting portion 25*b* by the bonding wire 48. Moreover, the semiconductor light-emitting element 45 disposed at the other end of the first light-emitting element row 45R is connected to the first wire connecting portion 26*b* by the bonding wire 49.

Similarly, the semiconductor light-emitting elements 45 extending in line in a direction across the common wire connecting portion 25*b* and the second wire connecting portion 26*d*, e.g., in a direction perpendicular to the common wire connecting portion 25*b* and the second wire connecting portion 26*d* are connected in series to each other by the bonding wire 50. The semiconductor light-emitting element 45 which is thus connected in series and disposed at one end of a second light-emitting element row 45L is connected to the common wire connecting portion 25*b* by the bonding wire 51. The semiconductor light-emitting element 45 disposed at the other end of the second light-emitting element row 45L is connected to the second wire connecting portion 26*d* by the bonding wire 52 (fourth manufacturing process). All of the bonding wires 47 to 52 are made of metal thin wires, preferably, gold wires, and are provided by wire bonding.

The semiconductor light-emitting elements 45 mounted on the module substrate 22 are electrically connected as described above, thereby configuring the chip-on-board (COB) type light-emitting module 21. The semiconductor light-emitting elements 45 provided in the element arrangement areas S1 and S2 by the electrical connection are arranged so that, for example, twelve first light-emitting element rows 45R each comprising seven semiconductor light-emitting elements 45 connected in series and, for example, twelve second light-emitting element rows 45L each comprising seven semiconductor light-emitting elements 45 connected in series are electrically connected in parallel.

The first light-emitting element row 45R and the second light-emitting element row 45L extend from each other, and the alignment marks 35 and 36 are further provided to respectively extend from these light-emitting element rows. With reference to the right and left (in the diagram) alignment marks 35 and 36 as the extensions, the semiconductor light-emitting elements 45 are mounted by a mounting machine (not shown) on straight lines that run through these alignment marks.

Furthermore, the first light-emitting element rows 45R and the second light-emitting element rows 45L are provided on both sides of the common wire connecting portion 25*b* so that the total of a length L of the first light-emitting element row 45R and a length M of the second light-emitting element row 45L located to extend from the first light-emitting element row 45R shown in FIG. 8 is substantially equal to a length N (see FIG. 7) of the common wire connecting portion 25*b*.

Thus, as shown in FIG. 7 and FIG. 8, all the semiconductor light-emitting elements 45 are evenly arranged in a square region S having a small difference between a first arrangement dimension X in an element row arrangement direction and a second arrangement dimension Y in a direction perpendicular to the element rows.

The first arrangement dimension X is the sum of the length L of the first light-emitting element row 45R, the length M of the second light-emitting element row 45L located to extend from the first light-emitting element row 45R, the width of the common wire connecting portion 25*b*, and the value of double the distance between the edge of the common wire connecting portion 25*b* and the adjacent semiconductor light-emitting element 45. The second arrangement dimension Y is the dimension in the arrangement direction of the first light-emitting element rows 45R and the dimension the arrangement direction of the second light-emitting element rows 45L.

Moreover, the above-mentioned "square region S having a small difference between the first arrangement dimension X and the second arrangement dimension Y" means a region in which the second arrangement dimension Y is 65% or more and 135% or less relative to the first arrangement dimension X. Therefore, the region S also includes a shape having no dimensional difference, that is, a square shape in which the first arrangement dimension X and the second arrangement dimension Y are equal.

As shown in FIG. 5 and FIG. 9, the frame 55 is in the shape of, for example, a quadrangular ring, and is attached to the mounting surface 22*a* to encompass the wire connecting portions 25*b*, 26*b*, and 26*d*, the semiconductor light-emitting elements 45, and the bonding wires 47 to 52. The frame 55 is preferably made of a white synthetic resin. This frame 55 is laid over part of the first protective layer 37 and part of the second protective layer 38.

The sealing resin 57 fills the frame 55, and is provided on the module substrate 22 (fifth manufacturing process). The wire connecting portions 25*b*, 26*b*, and 26*d*, the semiconductor light-emitting elements 45, and the bonding wires 47 to 52 are buried and enclosed in the sealing resin 57. Although a translucent resin material such as a silicone resin is used as the sealing resin 57, an epoxy resin or a urea resin, for example, can be used instead. The sealing resin 57 is gas-permeable.

A fluorescent material 70 (see FIG. 10) is mixed in the sealing resin 57. When excited by light emitted from the semiconductor light-emitting elements 45, the fluorescent material emits light different in color from the excitation light, and combines the color of the emitted light and the color of the light emitted from the semiconductor light-emitting elements 45 to produce light having a color necessary for illumination. When a blue LED is used for the semiconductor light-emitting element, a yellow fluorescent material is used to obtain white illumination light. In a condition in which an LED that emits ultraviolet rays is used for the semiconductor light-emitting element, red, blue, and yellow fluorescent materials can be used to obtain white illumination light.

White light is produced by mixing the blue light emitted by the blue LED with the yellow light which is a complementary color of the blue light. The white light exits from the surface of the sealing resin 57 in a direction in which the light is used. Therefore, a light-emitting surface 57*a* of the light-emitting module 21 is formed by the surface, that is, light exit surface of the sealing resin 57. The size of the light-emitting surface 57*a* is defined by the frame 55.

When the area of the silver part covered with the sealing resin 57 is C and the area of the light-emitting surface 57*a* is D, the occupancy of the area C relative to the area D is set to 5% or more and 40% or less. The parts of the wiring patterns 25 and 26 covered with the sealing resin 57 are the wire connecting portions 25*b*, 26*b*, and 26*d*. The area of a reflecting region covered with the sealing resin 57 is defined by the frame 55, and is sized by a longitudinal inside dimension of the frame 55 of, for example, 13 mm and a lateral inside dimension of the frame 55 of, for example, 17.5 mm in FIG. 9.

The sealing resin 57 may be provided by providing a mold member corresponding to the frame 55, filling the mold member with the sealing resin 57, and then releasing the mold member from the module substrate 22. In this case, the first protective layer 37 or the second protective layer 38 should be previously laid over the parts of the wiring patterns 25 and 26 outside the sealing resin 57.

Shown in FIG. 5, one connector 61 and two condensers 65 comprising surface-mounted components are mounted on the component mounting surface 22*a* (sixth manufacturing process).

That is, the connector 61 has a double-pin configuration provided with a first terminal pin 61*a* and a second terminal pin 61*b* that protrude from one side of the connector. The connector 61 is soldered to the mounting pads 33, and is thereby provided between the lighting inspection pads 28 and 29. The first terminal pin 61*a* is soldered to the first positive pad portion 25*c*, and the second terminal pin 61*b* is soldered to the first negative pad portion 26*e*. A direct-current-supply electric wire coated for insulation which is connected to an unshown power supply unit is plugged into the connector 61. As a result, electricity can be supplied to the light-emitting module 21 via the connector 61.

One of the two condensers 65 is soldered to and provided over the second positive pad portion 25*d* of the wiring pattern 25 and one end of the middle pad 27, within the first clearance 37*a* of the first protective layer 37. The other condenser 65 is soldered to and provided over the second negative pad portion 26*f* of the wiring pattern 26 and the other end of the middle pad 27, within the second clearance 37*b* of the first protective layer 37. No current runs through the condensers 65 in a normal lighting condition in which a direct current is supplied to the semiconductor light-emitting elements 45. However, in the event of an alternating current running because as a result of superposed noise, a current runs through the condensers 65, and a short circuit is thereby caused between the wiring patterns 25 and 26 to prevent the alternating current from running through the semiconductor light-emitting elements 45. Thus, the condensers 65 prevent abnormal light emission and erroneous lighting of the semiconductor light-emitting elements 45, and constitute an erroneous lighting preventing component or a noise countermeasure component.

As shown in FIG. 5, the two condensers 65 are disposed in the vicinity of the connector 61 outside the light-emitting surface (light-emitting region) 57*a*. In the present embodiment, the condensers 65 are positioned slightly off to the side from the point between the frame 55 and the connector 61 outside the frame 55.

As shown in FIG. 10, the height of the condenser 65 is smaller than the height of the Connector 61. Taller electric components are provided farther from the center, that is, light emission center of the sealing resin 57 that emits light by excitation as described above. More specifically, a sign J in FIG. 10 indicates the distance between the condenser 65 smaller in height than the connector 61 and the light emission center, and a sign K indicates the distance between the connector 61 greater in height than the condenser 65 and the light emission center. The distance K is longer than the distance J.

The electric components are arranged in accordance with their heights, so that as represented by arrows in FIG. 10, an angle θ between an emitted ray H radiating from the semiconductor light-emitting element 45 and the mouhting surface 22*a* can be decreased. Accordingly, it is possible to prevent the emitted ray H from being blocked by the tall connector 61, and increase the angle of the light emitted from the light-emitting surface 57*a*.

In the light-emitting module 21 having the above-described configuration, the first light-emitting element rows 45R are provided in the first element arrangement area S1 formed on one side of the common wire connecting portion 25*b* of the first wiring pattern 25, and the second light-emitting element rows 45L are provided in the second element arrangement area S2 formed on the other side of the common wire connecting portion 25*b*. Both the light-emitting element rows 45R and 45L are connected to the common wire connecting portion 25*b* by wire bonding. Thus, the common wire connecting portion 25*b* is shared by the first light-emitting element rows 45R and the second light-emitting element rows 45L.

As a result, there is no need to individually provide a wire connecting portion pairing with the first wire connecting portion 26*b* and a wire connecting portion pairing with the second wire connecting portion 26*d*. Therefore, no space to keep the insulation distance is needed between the first light-emitting system constituted of the parallel first light-emitting element rows 45R and the adjacent second light-emitting system constituted of the parallel second light-emitting element rows 45L. Moreover, the use of the common wire connecting portion 25*b* allows a reduction in the number of wire connecting portions necessary for the whole light-emitting module 21.

It is therefore possible to reduce the area to provide the semiconductor light-emitting elements 45 and thereby reduce the size of the light-emitting module 21 on which the semiconductor light-emitting elements 45 are highly densely mounted. The use of the common wire connecting portion 25*b* also eliminates the necessity of individually providing a wire connecting portion pairing with the first wire connecting portion 26*b* and a wire connecting portion pairing with the second wire connecting portion 26*d* as described above. It is therefore possible to reduce the amount of a metal to produce the wiring patterns and reduce costs accordingly.

Furthermore, as the common wire connecting portion 25*b* of the first wiring pattern 25 is shared, the first light-emitting element rows 45R and the second light-emitting element rows 45L are electrically parallel. It is therefore not necessary to increase the number of the semiconductor light-emitting elements 45 of the first light-emitting element rows 45R and the number of the semiconductor light-emitting elements 45 of the second light-emitting element rows 45L. Thus, the first light-emitting element rows 45R and the second light-emitting element rows 45L can emit light by the application of a low voltage. As a result, the circuit configuration of the unshown power supply unit provided in the streetlamp 1 is not required to supply high voltage to the light-emitting module 21, so that the power supply unit can be reduced in cost.

As shown in FIG. 10, the light-emitting module 21 having the above-described configuration is supported on the device base 11 so that the rear surface of the module substrate 22, that is, the surface opposite to the mounting surface 22*a* is in close contact with the bottom surface 12*a* of the module placement portion 12. Thus, the light-emitting module 21 is supported on the device base 11 se that heat can be released from the module substrate 22 to the module placement portion 12. When the light-emitting module 21 thus supported is attached to the lamp body 4, the light-emitting surface 57*a* faces the translucent plate 5.

As shown in FIG. 4 and FIG. 10, for example, two metal holding plates 71 is screwed to the device base 11 to support the light-emitting module. The ends of the holding plates 71 face the peripheral portion of the module substrate 22, and to these ends, metal springs 72 for pressing the peripheral portion of the module substrate 22 are attached. The rear surface of the module substrate 22 is kept in close contact with the bottom surface 12*a* by the spring force of the springs 72. Such a support structure can prevent the damage to the module substrate 22 even if stress acts on the ceramics module substrate 22 in a heat cycle based on a temperature rise and a temperature drop responsive to the turning on and off of the light-emitting module 21.

When electricity is supplied to the streetlamp 1 having the configuration described above, the semiconductor light-emitting elements 45 of the light-emitting module 21 simultaneously emit light. Thus, white light emitted from the light-emitting surface 57*a* directly passes through the translucent plate 5, or is reflected by the inner surface of the reflector 15 and then passes through the translucent plate 5, and irradiates the road to be irradiated. In this illumination, the light reflected by the first reflecting plate 15*a* and the second reflecting plate 15*b* comprising plane mirrors radiates mainly in the longitudinal direction of the road substantially without widening. At the same time, the light reflected by the third reflecting plate 15*c* and the fourth reflecting plate 15*d* comprising curved mirrors radiates mainly in the width direction of the road so that its radiation angle to the width direction of the road is controlled.

The light exiting from the light-emitting surface 57*a* includes the light directly passing through the sealing resin 57 from the semiconductor light-emitting elements 45, and the light emitted from the fluorescent material within the sealing resin 57 and passing through the sealing resin 57. The light exiting from the light-emitting surface 57*a* also includes the light entering the component mounting surface 22*a* through the element substrates of the semiconductor light-emitting elements 45 and the die bonding material, reflected by the mounting surface 22*a*, and passing through the sealing resin 57, and the light emitted from the fluorescent material, entering the component mounting surface 22*a* through the sealing resin 57, reflected by the component mounting surface 22*a*, and again passing through the sealing resin 57.

As has already been described, the module substrate 22 having the component mounting surface 22*a* is made of white ceramics, and its average reflectance is 80% or more. Thus, the light-emitting module 21 can efficiently reflect, in a road direction or in a light extracting direction, the light entering the mounting surface 22*a*, that is, blue light having an emission wavelength of 440 nm to 460 nm emitted by the blue LEDs that constitute the semiconductor light-emitting elements 45, and yellow light having an emission wavelength of 470 nm to 490 nm emitted by the fluorescent material. Especially when the average reflectance of the mounting surface 22*a* of the module substrate 22 is 85% or more and 99% or less, the light entering the mounting surface 22*a* can be more efficiently reflected in the light extracting direction.

The module substrate 22 having the component mounting surface 22*a* which reflects light as described above is made of white ceramics, and its bare surface is used as the mounting surface 22*a*. Therefore, constant reflection performance of the module substrate 22 is maintained regardless of the time elapsed from the start of the use of the light-emitting module 21.

Light reflection on the side of the module substrate 22 takes place not only in the mounting surface 22*a* but also in the common wire connecting portion 25*b* of the silver wiring pattern 25 enclosed by the sealing resin 57 and in the first wire connecting portion 26*b* and the second wire connecting portion 26*d* of the silver wiring pattern 26. In the meantime, the silver wire connecting portions 25*b*, 26*b*, and 26*d* react with a sulfur component in the air (sulfurate). Therefore, as longer time elapses since the installation of the streetlamp 1, the streetlamp 1 blackens, and its reflection performance gradually decreases.

In the light-emitting module 21 having the above-described configuration, the occupancy of the areas of the silver wire connecting portions 25*b*, 26*b*, and 26*d* relative to the area of the light-emitting surface 57*a* is set to 40% or less as described above. In other words, the reflection area in the component mounting surface 22*a* is sized at more than 60% of the area of the light-emitting surface 57*a*. In this case, the positive pattern base 25*a* of the silver wiring pattern 25 and the middle pattern portion 26*c* of the silver wiring pattern 26 are not enclosed by the sealing resin 57 and are outside the light-emitting surface 57*a*, which is preferable when the area occupancy is set to be 40% or less.

The above-mentioned setting of the area occupancy makes it possible to reduce the effect of the decrease of the light reflection performance attributed to the blackening of the wire connecting portions 25*b*, 26*b*, and 26*d* on the light reflection performance of the whole light-emitting module 21. Thus, the light-emitting module 21 according to the present embodiment can slow the reduction of its luminous flux maintenance factor. In other words, the reduction of the light reflection performance of the reflecting region covered with the light-emitting surface 57*a* is slow. Accordingly, high light extracting efficiency is maintained, so that the energy saving effect can be enhanced.

As the reduction of the luminous flux maintenance factor is thus slow, it is possible to provide the streetlamp 1 which takes a long time before the light-emitting module 21 as a light source reaches the end of a prescribed life, for example, before the luminous flux maintenance factor reaches 70%. In other words, as the area occupancy of the light-emitting surface 57*a* relative to the enclosed silver part is 40% or less, the luminous flux maintenance factor of the light-emitting module 21 can be kept at 70% or more regardless of the blackening of the silver part even when the streetlamp (lighting apparatus) 1 is used beyond the recommended life. The recommended life which gives an indication of the replacement of the streetlamp 1 is set by a period in which the luminous flux maintenance factor reaches 70%.

Figure 11:
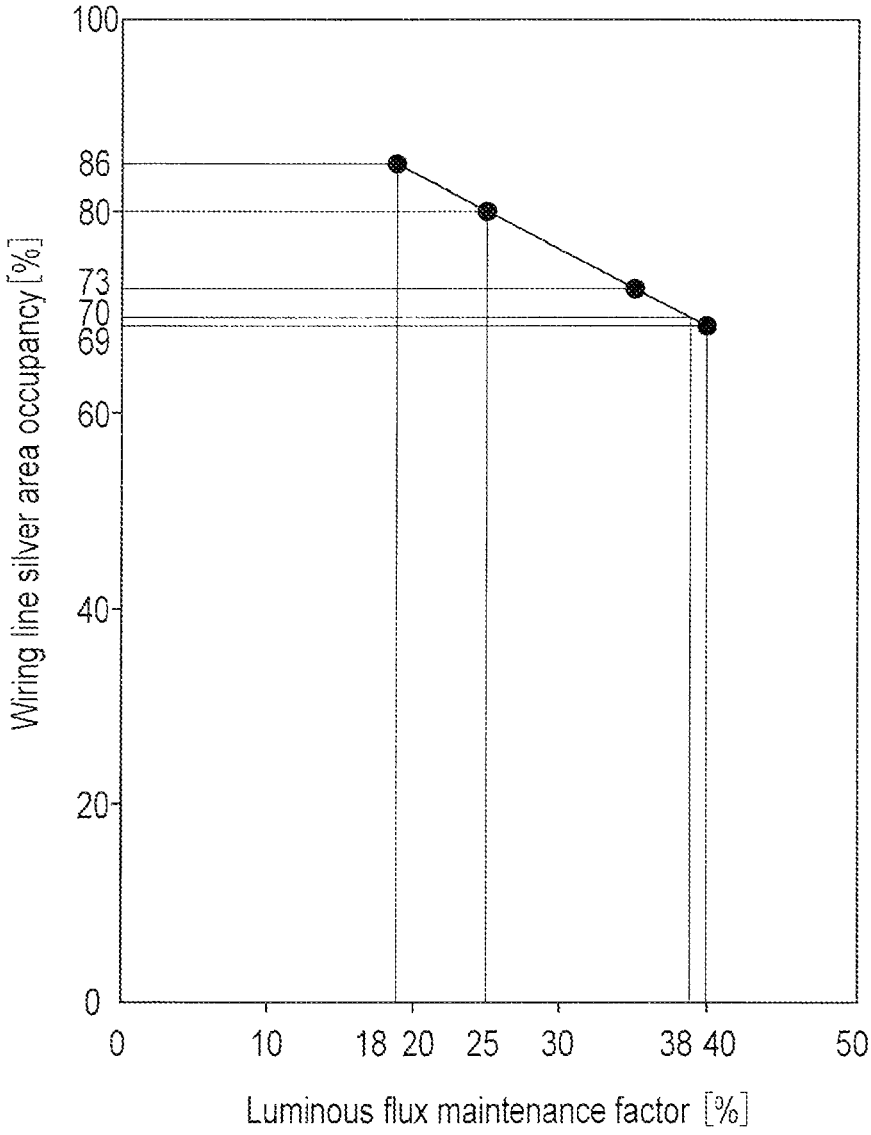
FIG. 11 is a graph showing the relation between a wiring line silver occupancy and a luminous flux maintenance factor in the light-emitting module.

FIG. 11 is a graph showing the relation between the luminous flux maintenance factor and the wiring line silver area occupancy in the light-reflecting region, based on the result of a test conducted by the inventor using the light-emitting module 21 having the above-described configuration. It has been found out from the test results that the luminous flux maintenance factor is 86% when the wiring line silver area occupancy is 18%, that the luminous flux maintenance factor is 80% when the wiring line silver area occupancy is 25%, that the luminous flux maintenance factor is 73% when the wiring line silver area occupancy is 35%, and that the luminous flux maintenance factor is 69% when the wiring line silver area occupancy is 40%. It is obvious from the results that the luminous flux maintenance factor can be 70% or more by setting the wiring line silver area occupancy to 40% or less. In particular, setting the wiring line silver area occupancy to 15% to 25% is preferable in that the luminous flux maintenance factor can be 80% or more.

If the area occupancy (i.e., the wiring line silver area occupancy) of the light-emitting surface 57*a* relative to the enclosed silver part is beyond 40%, the effect of the blackening of the silver part on the light reflection performance of the whole light-emitting module 21 is extremely high. As a result, the decrease of the luminous flux maintenance factor of the light-emitting module 21 is accelerated, and the time for the luminous flux maintenance factor to reach 70% is reduced. It is therefore improper in that the problem of the present embodiment cannot be solved.

The area occupancy (i.e., the wiring line silver area occupancy) of the wire connecting portions 25*b* and 26*b* of the wiring patterns 25 and 26 enclosed by the sealing resin 57 relative to the light-emitting surface 57*a* is 5% or more. Thus, the width of the wire connecting portions 25*b*, 26*b*, and 26*d* can be increased to some degree without hindering the wire bonding of the bonding wires 48, 49, 51, and 52 corresponding to these wire connecting portions. Accordingly, problems in manufacture can be eliminated.

Especially when the wiring line silver area occupancy is less than 15%, it is extremely difficult to enable the manufacture of the module substrate 22 because of the disappearance of the bonding wire region for mounting the LED chip semiconductor light-emitting elements 45 in the reflecting region having the above-mentioned area. However, such difficulty in mounting can be eliminated by setting the wiring line silver area occupancy to 15% or more. Thus, the module substrate 22 having a wiring line silver area occupancy of 15% or more and 25% or less is preferable in that there is no difficulty in manufacture and in that the luminous flux maintenance factor can be kept at 80% or more.

The light-emitting module 21 which emits light as described above has a configuration in which all the semiconductor light-emitting elements 45 are arranged on both sides of the common wire connecting portion 25*b* so that the total element row length which is the sum of the length L of the first light-emitting element row 45R and the length M of the second light-emitting element row 45L is substantially equal to the length N of the common wire connecting portion 25*b*.

Thus, when the semiconductor light-emitting elements 45 are highly densely arranged in the region having a limited area, there is no or a small dimensional difference between the longitudinal and lateral sides of the region S where all the semiconductor light-emitting elements 45 are mounted, as compared with a configuration in which all the light-emitting element rows are arranged in the extending direction of the common wire connecting portion 25*b*. As a result, the region S is not formed into an elongate shape.

All the semiconductor light-emitting elements 45 densely arranged evenly in the non-elongate region S simultaneously emit light in response to the application of electricity, such that the distribution of the light emitted from the light-emitting module 21 can be uniform in each direction. Moreover, the first light-emitting element rows 45R and the second light-emitting element rows 45L are arranged on both sides of the common wire connecting portion 25*b*, such that the region S having a small dimensional difference between its longitudinal and lateral sides as described above is large. Therefore, the number of the semiconductor light-emitting elements 45 mounted in the region S is great, and the sufficient amount of light necessary for illumination can be obtained.

Furthermore, as the first light-emitting element rows 45R and the second light-emitting element rows 45L of the light-emitting module 21 having the above-described configuration are electrically parallel, the wiring patterns for supplying electricity to these light-emitting element rows have only to be the single wiring pattern 25 and the single wiring pattern 26. The positive pattern base 25*a* of the wiring pattern 25 and the negative pattern base 26*a* of the wiring pattern 26 are provided side by side at the inter-base insulation distance A.

Therefore, although the light-emitting module 21 comprises the first light-emitting system constituted of the parallel first light-emitting element rows 45R and the adjacent second light-emitting system constituted of the parallel second light-emitting element rows 45L, a general-purpose low-cost double-pin connector can be used for the power supply connector 61.

On the other hand, the connector 61 is set to a small size adapted to the size of the light-emitting module 21. However, as the double-pin connector 61 is used, its pin distance, that is, the distance between the first terminal pin 61*a* and the second terminal pin 61*b* is great. As a result, in accordance with the pin distance, a great inter-base insulation distance A can be kept between the positive pattern base 25*a* and the negative pattern base 26*a* to which the terminal pins are soldered. Thus, although the first wiring pattern 25 and the second wiring pattern 26 are made of silver, a short circuit between the positive pattern base 25*a* and the negative pattern base 26*a* caused by, if any, silver migration therebetween can be prevented for a long period.

The end of the common wire connecting portion 25*b* and the longitudinal middle portion of the middle pattern portion 26*c* are separate from each other at the insulation distance B equal to or more than the inter-base insulation distance A. Thus, a short circuit between the common wire connecting portion 25*b* and the middle pattern portion 26*c* caused by, if any, silver migration therebetween can be prevented for a long period.

The first light-emitting element rows 45R and the second light-emitting element rows 45L provided in the light-emitting module 21 are symmetrical with respect to the common mire connecting portion 25*b*. The alignment marks 35 and 36 are made of the metal the first wiring pattern 25 and the second wiring pattern 26, and are provided on the module substrate 22 to extend from the first light-emitting element rows 45R and from the second light-emitting element rows 45L that extend from the first light-emitting element rows 45R.

Thus, the first wiring pattern 25, the second wiring pattern 26, and the alignment marks 35 and 36 that are made of the same metal can be formed on the module substrate 22 in the same process (first manufacturing process). This makes it possible to contribute to a reduction in cost.

The alignment marks 35 arranged along and in the vicinity of the first wire connecting portion 26*b* are provided 1.0 mm or more apart from the edge of the first wire connecting portion 26*b*. The alignment marks 36 arranged along and in the vicinity of the second wire connecting portion 26*d* are provided 1.0 mm or more apart from the edge of the second wire connecting portion 26*d*. It is therefore possible to improve the disadvantageous situation in which, for example, a mounting head of the unshown mounting machine is damaged because the mounting machine incorrectly recognizes the alignment marks when the semiconductor light-emitting elements 45 are mounted on the module substrate 22 by the mounting machine.

That is, when the semiconductor light-emitting elements 45 are mounted in the first element arrangement area S1 and the second element arrangement area S2 of the module substrate 22 by the mounting machine, this mounting machine is provided between the first element arrangement area S1 and the second element arrangement area S2, and recognizes the alignment marks 35 and 36 at the same height in FIG. 7 to mount the semiconductor light-emitting elements 45 at intervals on the straight lines that run through the alignment marks 35 and 36. In this mounting, when the mounting machine recognizes the alignment marks 35 and 36 at the same height, correct mounting is achieved.

However, the distance between the alignment marks 35 extending in line along the first wire connecting portion 26*b* and the distance between the alignment marks 36 extending in line along the second wire connecting portion 26*d* are small. Thus, the mounting machine may incorrectly recognize some other alignment mark adjacent to one alignment mark row in the extending direction of this row, and the semiconductor light-emitting elements 45 may be improperly mounted.

For example, after recognizing the top alignment marks in FIG. 7 (indicated by signs 35*a* and 36*a* for identification in FIG. 7) and performing normal mounting, the mounting machine should then recognize the second alignment marks from the top in FIG. 7 (indicated by signs 35*b* and 36*b* for identification). However, the mounting machine may incorrectly recognize the alignment mark 35*b* and the top alignment mark 36*a* in FIG. 7 and perform mounting.

In this case, a faulty mounting line L2 (see FIG. 7) of the improperly mounted semiconductor light-emitting elements 45 is tilted relative to a normal mounting line L1 (see FIG. 7) of the normally mounted semiconductor light-emitting elements 45. The normal mounting line L1 and the faulty mounting line L2 converge toward the alignment mark 36*a*. Therefore, as the convergence point approaches, the semiconductor light-emitting elements 45 to be mounted in the faulty mounting line L2 may interfere with the semiconductor light-emitting elements 45 that have already been mounted in the normal mounting line L1.

However, the alignment marks 35 are 1.0 mm or more apart from the edge of the first wire connecting portion 26*b*, and the alignment marks 36 are 1.0 mm or more apart from the edge of the second wire connecting portion 26*d*. Thus, the distance between the alignment marks 35 and 36 is great, so that the faulty mounting line L2 is less inclined relative to the normal mounting line L1, and the minimum distance between these lines in the region S where all the semiconductor light-emitting elements 45 are arranged can be greater. In addition, the region S is set between the first wire connecting portion 26*b* and the second wire connecting portion 26*d*, and is relatively greatly distant from the convergence point. In this respect as well, the minimum distance between both lines in the region S can be longer.

It is therefore possible to inhibit the interference of the semiconductor light-emitting elements 45 to be mounted in the faulty mounting line L2 with the semiconductor light-emitting elements 45 that have already been mounted in the normal mounting line L1. This can improve the disadvantageous situation in which, for example, the mounting head of the mounting machine is damaged.

The distance E between the alignment marks 35 and 36 and the edge of the module substrate 22 of the light-emitting module 21 is longer than the distance G between the alignment mark 35 and the edge of the first wire connecting portion 26*b* and the distance G between the alignment mark 36 and the edge of the second wire connecting portion 26*d*. As a result, a creepage distance necessary for insulation can be kept between the alignment marks 35 and 36 and the module substrate 22. In addition, in handling such as carriage and setting during the manufacture of the light-emitting module 21, a part that allows the module substrate 22 to be handled without interfering with the alignment marks 35 and 36 can be secured in the peripheral part of the module substrate 22.

The light-reflecting region of the module substrate covered with the sealing resin 57 to reflect incident light in the light extracting direction, and parts of the wiring patterns 25 and 26 disposed in the light-reflecting region are covered with and enclosed by the sealing resin 57. In addition, the rest of the wiring patterns 25 and 26, that is, sealing material outside parts which are provided outside the sealing resin 57 and which are not enclosed by the sealing resin 57 are enclosed by the first protective layer 37 or the second protective layer 38 that are laid over these parts.

This inhibits the wiring patterns 25 and 26 containing silver as the main component from being sulfurated by the sulfur component in the air. It is therefore possible to inhibit the wiring patterns 25 and 26 in which paths for supplying electricity to the semiconductor light-emitting elements 45 are formed from deteriorating and increasing resistance.

In this case, the first protective layer 37 and the second protective layer 38 are provided in the sealing material outside parts of the wiring patterns 25 and 26 that are not enclosed by the sealing resin 57 in such a manner as to be limited to the size of the periphery of this part. Therefore, the first protective layer 37 and the second protective layer 38 are far smaller than the module substrate 22 and are only provided in parts of the module substrate 22. Thus, the amount of material used to form the first protective layer 37 and the second protective layer 38 can be substantially minimized, so that the increase of resistance in the wiring patterns 25 and 26 containing silver as the main component can be prevented at low costs.

Moreover, the first protective layer 37 and the second protective layer 38 are provided outside the region enclosed by the sealing resin 57. Therefore, the first protective layer 37 and the second protective layer 38 do not enter the enclosed region and reduce the light-reflecting area of the module substrate 22 having a size corresponding to the area of the sealing resin 57. In addition, although the first protective layer 37 and the second protective layer 38 are black in contrast with the color of the bare surface of the module substrate 22 serving as the light-reflecting surface, light-reflecting performance on the side of the module substrate 22 is not decreased by light absorption in the first protective layer 37 and the second protective layer 38.

Furthermore, the first positive pad portion 25*c* and the first negative pad portion 26*e* to which the power supply connector 61 is connected by solder are provided outside the region enclosed by the sealing resin 57. Therefore, the light-reflecting area of the module substrate 22 does not decrease compared with the case where the power supply pad portions are provided in the region enclosed by the sealing resin 57. In addition, the first positive pad portion 25*c* and the first negative pad portion 26*e* do not become factors that disturb the light reflection on the side of the module substrate 22. In addition, the side of the module substrate 22 in the enclosed region is not made uneven due to the connector 61 attached to the first positive pad portion 25*c* and the first negative pad portion 26*e*. Thus, the light reflection on the side of the module substrate 22 is not disturbed.

Similarly, the second positive pad portion 25*d*, the second negative pad portion 26*f*, and the middle pad 27 that are component connecting pad portions are exposed in the first clearance 37*a* and the second clearance 37*b* of the first protective layer 37 that are located outside the enclosed region. The condensers 65 are soldered to these parts. That is, the condensers 65 for preventing abnormal light emission of the semiconductor light-emitting elements 45 are placed outside the enclosed region. Thus, as compared with the case where these component connecting pad portions are provided in the region enclosed by the sealing resin 57, the light-reflecting area of the module substrate 22 is not decreased by component connecting pad portions, and the light-reflecting surface on the side of the module substrate 22 is not easily disturbed. Moreover, the side of the module substrate 22 is not made uneven in the enclosed region due to the condensers 65 attached to the component connecting pad portions. Thus, the light reflection on the side of the module substrate 22 is not disturbed. It should be noted that a zener diode can be used as an electric component for preventing abnormal light emission instead of the condenser.

As described above, according to the light-emitting module 21 having the above-described configuration, the light-reflecting area on the side of the module substrate 22 in the region enclosed by the sealing resin 57 is not decreased by the protective lavers and the pad portions formed on the module substrate 22 and by the electric components mounted on the module substrate 22. Moreover, light reflection is not easily disturbed, and light can be properly reflected on the side of the module substrate 22. Consequently, light extracting efficiency can be increased.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fail within the scope and spirit of the inventions.

What is claimed is:

1. A light-emitting module comprising:

a module substrate;

a first wiring pattern provided on the module substrate and having a common wire connecting portion;

a second wiring pattern provided on the module substrate around the first wiring pattern and opposite in polarity from the first wiring pattern, the second wiring pattern having a first wire connecting portion which defines a first element arrangement area between the first wire connecting portion and the common wire connecting portion, a second wire connecting portion which is opposite to the first wire connecting portion across the common wire connecting portion and which defines a second element arrangement area between the second wire connecting portion and the common wire connecting portion, and a middle pattern portion connecting the first wire connecting portion to the second wire connecting portion;

a first light-emitting element group arranged in the first element arrangement area and including semiconductor light-emitting elements connected in series and electrically connected to the common wire connecting portion and the first wire connecting portion; and a second light-emitting element group arranged in the second element arrangement area and including semiconductor light-emitting elements connected in series and electrically connected to the common wire connecting portion and the second wire connecting portion.

2. The light-emitting module according to claim 1, wherein the first light-emitting element group includes a plularity of first light-emitting element rows each extending in a direction across the common wire connecting portion and the first wire connecting portion, and the second light-emitting element group includes a plularity of second light-emitting element rows each extending in a direction across the common wire connecting portion and the second wire connecting portion.

3. The light-emitting module according to claim 2, wherein the first light-emitting element rows and the second light-emitting element rows are arranged on both sides of the common wire connecting portion so that a total element row length which is the sum of the lengths of a first light-emitting element row and a second light-emitting element row is approximately equal to the length of the common wire connecting portion.

4. The light-emitting module according to claim 1, wherein the first wiring pattern includes a pattern base connected to the common wire connecting portion, and the second wiring pattern includes a pattern base connected to one of the first and second wire connecting portions, these pattern bases being provided adjacent at an inter-base insulation distance, which further comprises a power supply portion including two terminal pins and mounted on the module substrate, the two terminal pins being individually connected to the pattern bases.

5. The light-emitting module according to claim 4, wherein an end of the common wire connecting portion and a longitudinal middle portion of the middle pattern portion are separate from each other at an insulation distance equal to or more than the inter-base insulation distance.

6. The light-emitting module according to claim 1, wherein the first light-emitting element group and the second light-emitting element group are arranged symmetrically with respect to the common wire connecting portion, which further comprises first alignment marks provided in line on the module substrate outside the first wire connecting portion, and second alignment marks provided in line on the module substrate outside the second wire connecting portion, and wherein the first and second alignment marks are made of the same metal as the first and second wiring patterns, the first alignment marks are located closer to the first wire connecting portion with being 1.0 mm or more apart from the edge of the first wire connecting portion, the second alignment marks are located closer to the second wire connecting portion with being 1.0 mm or more apart from the edge of the second wire connecting portion.

7. The light-emitting module according to claim 6, wherein a distance between the first alignment marks and the edge of the module substrate is longer than a distance between the first alignment marks and the first wire connecting portion, and a distance between the second alignment marks and an edge of the module substrate is longer than a distance between the second alignment marks and the second wire connecting portion.

8. The light-emitting module according to claim 1, which further comprises a translucent sealing resin having a fluorescent material and provided on the module substrate to seal the semiconductor light-emitting elements, the first and second wiring patterns, and bonding wires connecting the semiconductor light-emitting elements, the sealing resin comprising a light-emitting surface, wherein an occupancy of areas of the first and second wiring patterns covered with the sealing resin relative to the light-emitting surface is 5% or more and 40% or less.

9. The light-emitting module according to claim 8, wherein the average visible light reflectance of the module substrate is 85% or more and 99% or less.

10. The light-emitting module according to claim 9, wherein the module substrate is made of white ceramics, the first and second wiring patterns are made of a metal containing silver as a main component, and the semiconductor elements are electrically connected by bonding wires.

11. The light-emitting module according to claim 8, which further comprises a power supply portion mounted on the module substrate outside the light-emitting surface and connected to the first wiring pattern and the second wiring pattern; and an electric component connected between the first wiring pattern and the second wiring pattern and configured to prevent abnormal light emission of the semiconductor light-emitting elements, the electric component being mounted in the vicinity of the power supply portion outside the light-emitting surface and displaced from a position between the light-emitting surface and the power supply portion.

12. The light-emitting module according to claim 11, which further comprises a frame provided on the module substrate around the sealing resin; and a protective layer formed to overlap parts of the first wiring pattern and the second wiring pattern which are outside of the sealing resin.

13. The light-emitting module according to claim 12, wherein a bare surface of the module substrate forms a light-reflecting surface, and the protective layer is different in color from the bare surface.

14. A lighting apparatus comprising:

a light source device comprising the light-emitting module according to claim 1; and an apparatus body to which the light source device is attached.

* * * * *